US012516599B2

(12) United States Patent
Dokhon et al.

(10) Patent No.: US 12,516,599 B2
(45) Date of Patent: Jan. 6, 2026

(54) MONITORING CORROSION IN DOWNHOLE EQUIPMENT

(71) Applicant: Saudi Arabian Oil Company, Dhahran (SA)

(72) Inventors: Waleed A. Dokhon, Khobar (SA); Ahmed Alsmaeil, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 399 days.

(21) Appl. No.: 17/549,356

(22) Filed: Dec. 13, 2021

(65) Prior Publication Data

US 2023/0184088 A1 Jun. 15, 2023

(51) Int. Cl.
*E21B 47/00* (2012.01)

(52) U.S. Cl.
CPC ..... *E21B 47/006* (2020.05)

(58) Field of Classification Search
CPC ..... E21B 47/006; E21B 17/00
USPC ..... 702/6
See application file for complete search history.

(56) References Cited

U.S. PATENT DOCUMENTS

| | | | | |
|---|---|---|---|---|
| 2,994,778 | A | 8/1961 | Marsh | |
| 3,348,052 | A | 10/1967 | Raifsnider et al. | |
| 10,961,444 | B1 * | 3/2021 | Bestaoui-Spurr | E21B 43/267 |
| 10,961,445 | B2 * | 3/2021 | Ogle | E21B 43/267 |
| 11,041,378 | B2 | 6/2021 | Chen et al. | |
| 2012/0118564 | A1 * | 5/2012 | Gomes | E21B 47/006 166/250.12 |
| 2017/0350230 | A1 * | 12/2017 | Drønen | C23F 13/22 |
| 2018/0306027 | A1 * | 10/2018 | Sherman | G01N 33/24 |
| 2019/0055839 | A1 * | 2/2019 | Skillingstad | E21B 33/12 |
| 2020/0024506 | A1 * | 1/2020 | Trudel | G01V 8/10 |
| 2020/0109621 | A1 * | 4/2020 | Elbadawy | E21B 27/02 |
| 2020/0378242 | A1 * | 12/2020 | Jabari | E21B 47/12 |
| 2022/0412210 | A1 * | 12/2022 | Fripp | G01N 33/2823 |
| 2023/0086904 | A1 * | 3/2023 | Marya | C09D 5/29 428/102 |

FOREIGN PATENT DOCUMENTS

| | | | | |
|---|---|---|---|---|
| WO | WO-9924812 | A1 * | 5/1999 | G01N 3/562 |
| WO | WO-2015097116 | A1 * | 7/2015 | E21B 43/267 |

(Continued)

OTHER PUBLICATIONS

Cao et al., "A highly selective and sensitive bifunctional luminescent sensor for TNP and Iron ion based on magnesium coordination polymer." Inorganica Chimica Acta 511, 119836, Jun. 2020, 8 pages.

(Continued)

*Primary Examiner* — Lisa M Caputo
*Assistant Examiner* — Joshua L Forristall
(74) *Attorney, Agent, or Firm* — Fish & Richardson P.C.

(57) ABSTRACT

Methods for detecting a corrosion in downhole equipment are described. The methods include incorporating a tracer layer including tracer particles in a piece of downhole equipment; deploying the piece of downhole equipment including the tracer layer into a wellbore; releasing the tracer particles from the tracer layer into the formation upon interaction of metal ions with the tracer layer; and analyzing levels of tracer particles in formation fluids produced to ground surface.

12 Claims, 4 Drawing Sheets

(56) References Cited

FOREIGN PATENT DOCUMENTS

| | | | | |
|---|---|---|---|---|
| WO | WO-2018056990 A1 * | 3/2018 | ..... | E21B 34/06 |
| WO | WO-2018164608 A2 * | 9/2018 | ..... | F17D 5/00 |

OTHER PUBLICATIONS

Ellis et al., "Successful Field Test of Real Time Inline Sensing System for Tracer Detection at Well Head" SPE-188035-MS, Society of Petroleum Engineers, Apr. 2017, 18 pages.

Oh et al., "Characterization of iron oxides commonly formed as corrosion products on steel." Hyperfine interactions 112.1-4, 1998, 59-66, 7 pages.

Thomas et al., "Deployment and Detection of a Novel Barcoded Advanced Tracers System for the Optimization of Improved Waterflood Recovery in Hydrocarbon Reservoirs" SPE-194872-MS, Society of Petroleum Engineers, Mar. 2019, 10 pages.

* cited by examiner

MONITORING CORROSION IN DOWNHOLE EQUIPMENT

TECHNICAL FIELD

The present disclosure generally relates to tools, methods, and systems for monitoring corrosion in downhole equipment, more particularly, using a layer with metallic tracers incorporated as part of the downhole equipment to monitor corrosion.

BACKGROUND

Corrosion in downhole equipment (e.g., production tubing, casing, pipe) is a process where the metal surface of the downhole equipment converts to an oxide. For example, iron oxides are formed when iron metal reacts with water and a byproduct (e.g., ferrous ions ($Fe^{2+}$)) forms and reacts with the environment.

Wireline operations, such as metal loss detectors, are commonly used to monitor and to detect corrosion in pipes. Wireline detection is a low-frequency and costly process that requires years of logging the well with long downtimes between wireline jobs. Wireline detection tools can detect an average value of the metal loss in a radial or in a longitudinal direction relative to the pipe.

SUMMARY

This specification describes tools, systems, and methods for monitoring and detecting corrosion in downhole equipment, for example, in an underground oil-reservoir environment. Monitoring and detecting corrosion allows one or more downhole assemblies with corrosion to be detected and replaced in a timely fashion. This approach monitors and detects corrosion using a tracer layer that includes metallic tracers incorporated in downhole equipment (e.g., pipes, electrical submersible pumps (ESPs), production tubing, or casing). For example, a tracer layer can be embedded in a pipe. Once corrosion of the pipe reaches a certain level (e.g., a certain percentage), the tracer layer is exposed and the metallic tracers are released into the formation. Regular surface sampling and analyses of the produced formation fluids can detect the metallic tracers in formation fluid. In some implementations, this approach monitors and detects corrosion using a tracer layer applied as a coating to a piece of downhole equipment (e.g., deposited on the outer surface of a pipe). The tracer coating can include metallic tracers and mesoporous materials. The tracer layer or coating can include multiple distinct types of tracers. For example, each distinct tracer can distinguish different levels of corrosion downhole (e.g., when incorporated as multiple embedded layers) or distinguish the different components of the downhole assembly (e.g., different tracers applied to different pieces of downhole equipment) that are subject to corrosion.

The described systems and methods for monitoring and detecting corrosion using a tracer layer incorporated in downhole equipment provides a simple approach to corrosion detection that can provide increased accuracy at a reduced cost relative to wireline monitoring.

In some aspects, a method for detecting a corrosion in downhole equipment includes incorporating a tracer layer including tracer particles in a piece of downhole equipment; deploying the piece of downhole equipment including the tracer layer into a wellbore; releasing the tracer particles from the tracer layer into the formation upon interaction of metal ions with the tracer layer; and analyzing levels of tracer particles in formation fluids produced to ground surface.

Embodiments of the method for detecting a corrosion in downhole equipment can include one or more of the following features.

In some embodiments, the method includes incorporating the tracer layer in the piece of downhole equipment by embedding the tracer layer into the piece of downhole equipment. In some cases, incorporating the tracer layer in the piece of downhole equipment includes incorporating a plurality of types of different tracer particles, each type of tracer particle associated with a different tracer layer. In some cases, incorporating the tracer layer in the piece of downhole equipment includes embedding the tracer layer in a pipe. In some cases, incorporating the tracer layer in the piece of downhole equipment includes coating a surface the pipe with the tracer layer.

In some embodiments, deploying the piece of downhole equipment includes deploying a plurality of tubulars comprising one or more tracer layers.

In some embodiments, incorporating the tracer layer in the piece of downhole equipment includes incorporating the tracer layer between a first piece of downhole equipment and a second piece of downhole equipment. In some cases, incorporating the tracer layer in the piece of downhole equipment includes incorporating a first tracer layer as a coating to the first piece of downhole equipment and a second tracer layer as a coating to the second piece of downhole equipment.

In some embodiments, releasing the tracer particles from the tracer layer into the formation upon interaction of metal ions with the tracer layer includes releasing the tracer particles from the tracer layer into the formation upon interaction of metal ions at a concentration of between 0 and 5 μM with the tracer layer.

In some embodiments, incorporating the tracer layer includes tracer particles in a piece of downhole equipment includes encapsulating the tracer particles into a porous material. In some cases, encapsulating the tracer particles into the porous material includes encapsulating the tracer particles into a silica. In some cases, encapsulating the tracer particles into the silica includes adding the silica with the encapsulated tracer particles to a pipe composition. In some cases, encapsulating the tracer particles into the silica includes adding the silica with the encapsulated tracer particles to a cement composition. In some cases, adding the silica with the encapsulated tracer particles to the pipe composition is between 1.5% and 35%.

In some embodiments, incorporating the tracer layer includes incorporating the tracer layer with a thickness between 5% and 10% of an inner wall of a pipe.

This approach can detecting integrity issues in pipes in a timely fashion and with increased accuracy. The described approach utilizes valuable assets without shutting down operations for long periods and scheduling preventive measures and workovers with reduced logging frequency.

Some implementations of the described method of detecting corrosion using the tracer layer use a combination of simple and scalable porous silica materials with a polymer responsive to iron ions to allow continuous monitoring, detection, and resolution of integrity issues in downhole equipment. This corrosion detection approach can be implemented as part of an annual sampling procedures executed by a user.

The details of one or more embodiments of the disclosure are set forth in the accompanying drawings and the description below. Other features, objects, and advantages of the disclosure will be apparent from the description and drawings, and from the claims.

DETAILED DESCRIPTION

This specification describes tools, systems, and methods for monitoring and detecting corrosion in downhole equipment, for example, in an underground oil-reservoir environment. Monitoring and detecting corrosion allows one or more downhole assemblies with corrosion to be detected and replaced in a timely fashion. This approach monitors and detects corrosion using a tracer layer that includes metallic tracers incorporated in downhole equipment (e.g., pipes, ESPs, production tubing, or casing). For example, a tracer layer can be embedded in a pipe. Once corrosion of the pipe reaches a certain level, the tracer layer is exposed and the metallic tracers are released into the formation. Regular surface sampling and analyses of the produced formation fluids can detect the metallic tracers in formation fluid. In some implementations, this approach monitors and detects corrosion using a tracer layer applied as a coating to a piece of downhole equipment (e.g., deposited on the outer surface of a pipe). The tracer coating can include metallic tracers and mesoporous materials. The tracer layer or coating can include multiple distinct types of tracers. For example, each distinct tracer can distinguish different levels of corrosion downhole (e.g., when incorporated as multiple embedded layers) or distinguish the different components of the downhole assembly (e.g., different tracers applied to different pieces of downhole equipment) that are subject to corrosion.

The described systems and methods for monitoring and detecting corrosion using a tracer layer incorporated in downhole equipment provides a simple approach to corrosion detection that can provide increased accuracy at a reduced cost relative to wireline monitoring.

Figure 1:
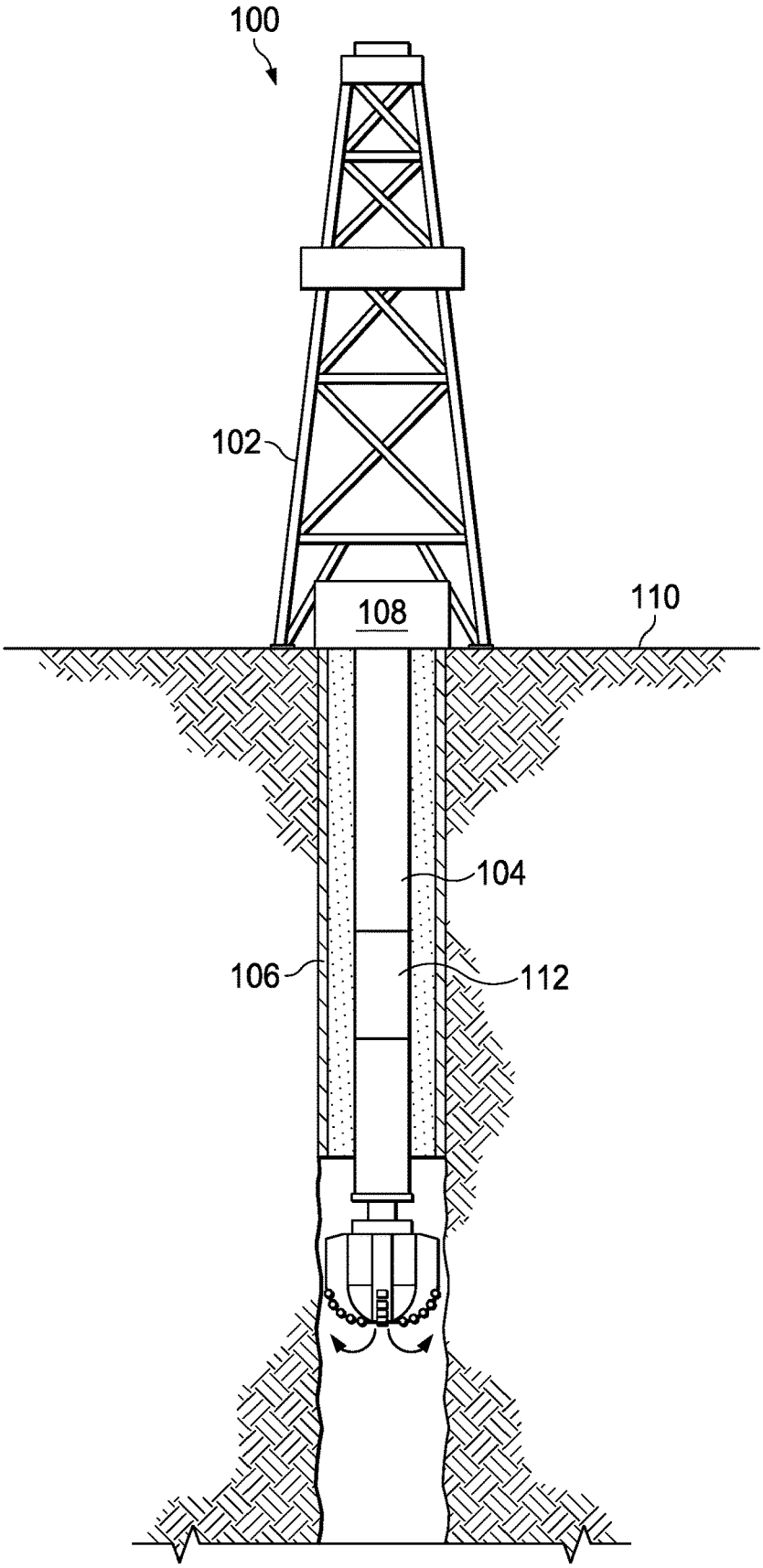
FIG. 1 is a schematic view of a subsurface reservoir including production tubing with a tracer layer.

FIG. 1 is a schematic view of a wellsite 100 that includes a derrick 102 that supports production tubing 104 within a wellbore 106. The production tubing 104 is run on a completion string from a wellhead 108 at the well surface 110. The production tubing 104 is formed of a series of metal pipes 112.

Corrosion is a natural process that converts a refined metal into a more chemically stable form such as oxide, hydroxide, carbonate or sulfide. For example, iron oxides are formed when iron metal reacts with water and a byproduct (e.g., ferrous ions ($Fe^{2+}$)) forms and reacts with the environment. Corrosion in downhole equipment can damage the equipment. For example, pressures, temperatures, and potentially corrosive conditions found in the wellbore 106 can cause corrosion in which the iron forming a pipe can be converted to iron oxide (i.e., rust) compromising the integrity of the pipes 112.

The pipes 112 incorporate a tracer layer such that corrosion releases the tracers into the formation when the corrosion exposes the tracer layer. By sampling formation fluids at the surface on an ongoing basis, this approach allows continuous monitoring of corrosion of the pipes 112. An embedded tracer layer 114 in the pipes 112 of downhole equipment can be used to monitor the amount of metal loss in pipes and/or indicate the type of equipment with corrosion. The method allows monitoring and detecting corrosion using the tracer layer 114 incorporated, for example, in the pipes 112.

Figure 2A:
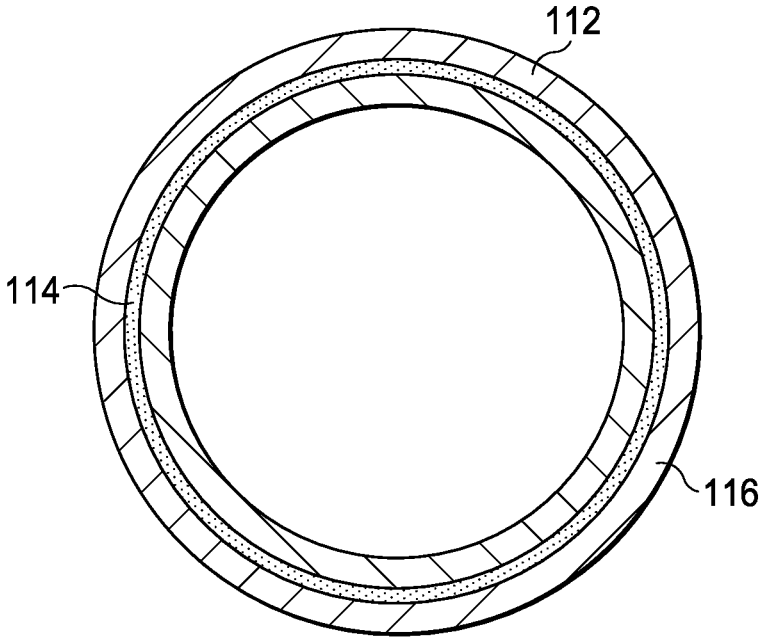
FIGS. 2A-2B are cross-sectional views of tracer layers incorporated in a pipes.
Figure 2B:
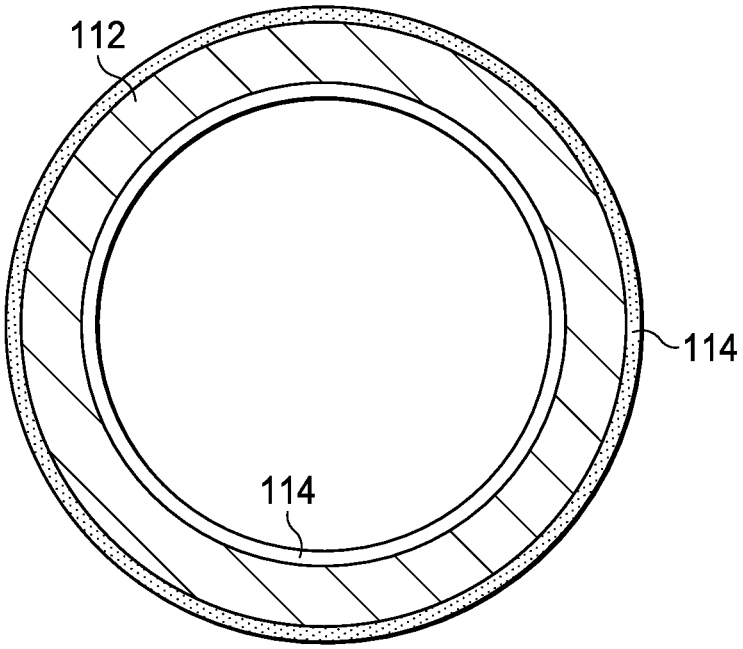

FIGS. 2A-2B are cross-sectional views of a tracer layer 114 incorporated in a pipe 112 in various configurations.

FIG. 2A illustrates the tracer layer 114 embedded inside a pipe wall 116. The illustrated pipe has an inner diameter of 3.958 inches and a wall thickness of 0.271 inches and illustrated tracer layer has a thickness of 0.02 inches. In the illustrated implementation, the tracer layer 114 is positioned halfway between the outer surface and the inner surface of the pipe 112. Release of the tracers from the tracer layer 114 into the formation indicates that the metal loss of the pipe 112 is deep into the wall of the pipe 112 and that the pipe 112 has lost at least 50% of its thickness in at least some portions of the pipe 112. In some implementations, the tracer layer 114 is located at other depths in the wall of the pipe chosen based on how much corrosion can occur before remedial action is needed.

FIG. 2B illustrates the tracer layer 114 incorporated as a coating on the outer and the inner surfaces of the pipe 112. In some implementations, the tracer layer 114 is incorporated as a coating on existing pipes. In some implementations, a layer is applied as a coating on just the outer surface or just the inner surface rather than both surfaces. The coating(s) can extend along the entire surface of a pipe 112 or can be applied only to a portion of the pipe. For example, in some implementations, the tracer layer 114 is applied a coating on the threads at casing or tubing joints. The tracer layer has a thickness between 5% and 10% of the inner wall of the pipe and a length depends on the region of interest where the carrion is present.

The tracer layer includes a coordination polymer material (e.g., ligand). A ligand is an ion or molecule (e.g., functional group) that binds to a central atom to form a coordination complex. In some embodiments, the coordination polymer is an inorganic polymer structure including metal cation (i.e., central atom) linked to ligands. In some embodiments, the coordination polymer is an organometallic polymer structure including metal cation linked to ligands. The central atom is linked to the ligands by a chemical bond.

Figure 3:
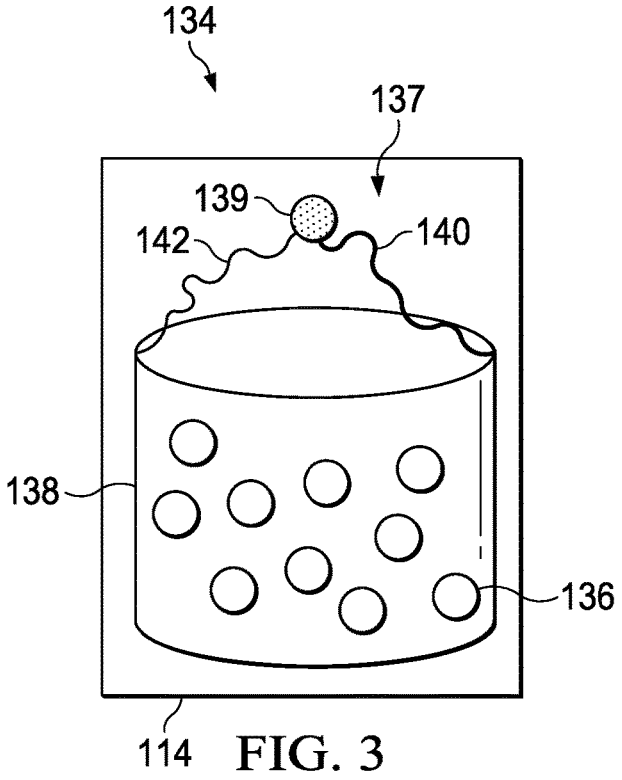
FIG. 3 is a schematic showing a structure of a tracer layer.

FIG. 3 is a schematic showing a structure 116 of a tracer layer 114. A synthesized luminescent coordination polymer that includes L3-ligands 140 and 142, water, and magnesium ions 139 (e.g., with a formulation $[Mg_3L_2\cdot(H_2O)_6]_2\cdot 12H_2O$), constructed by various H-bond, was used to form the tracer complex 137. In some implementations, the tracer complex 137 is encapsulated into a mineral-based porous material (e.g., silica) 138 that forms the tracer layer 114. Encapsulation is done during the synthesis of porous materials when the material is synthesized, the surfactant is extracted and replaced with the ligands of interest. The encapsulation process can be conducted using the approach described in "Encapsulation of an Anionic Surfactant into Hollow Spherical Nanosized Capsules: Size Control, Slow Release, and Potential Use for Enhanced Oil Recovery Applications and Environmental Remediation" by Alsmaeil et. al, ACS Omega 2021 6 (8), 5689-5697, incorporated in this disclosure in its entirety by reference. The silica 138 includes nanoparticles that can be used as carriers for the tracer molecules 136 from complex 137. For example, the silica material exists as part of the manufacturing process for pipes or for cements as it accounts for between 1.5% and 35% of the composition. In some implementations, silica is added directly to the content of the pipes or to the content of the cement. The amount of silica content present in the pipe or in the cement can be considered based on the approach described in "Advanced Well Completion Engineering," by Wan Renpu, 3rd Edition), (2011), and in "Chemical Elements Effect to Steel Pipe and Plates (Carbon and Alloy)," by Octal steel, 2021, incorporated in this disclosure in its entirety by reference. The formed tracer layer 114 is applied as a coating to the pipe 112 or integrated into the pipe's composition as described earlier with reference to FIGS. 2A-2B. The tracer complex 137 includes fluorescence characteristics that allow for good stability in acid-based conditions and high sensitivity for sensing metal ions (e.g., $Fe^{3+}$ ions). For example, the complex 137 can detect the presence of $Fe^{3+}$ ions at low concentrations (e.g., 0-5 micromolar (μM)).

Figure 4:
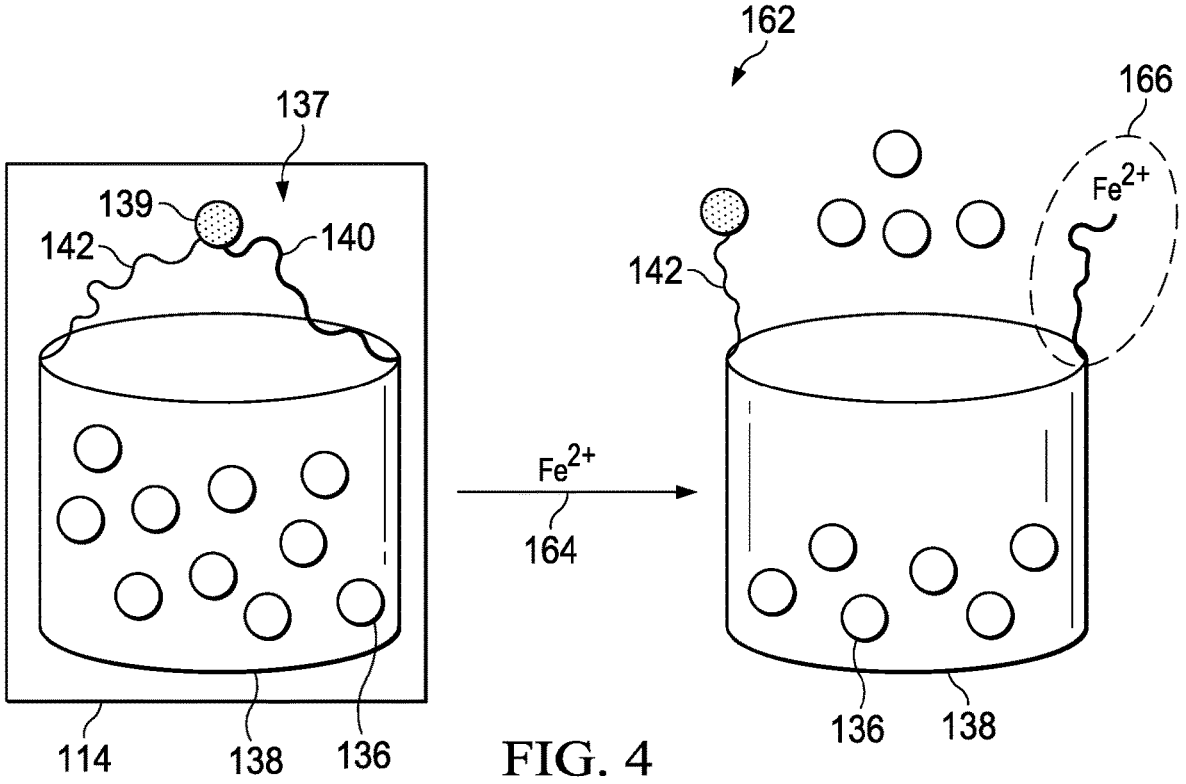
FIG. 4 is a schematic showing a process of a tracer layer reacting with iron oxides.

FIG. 4 is a schematic showing a process 162 of a tracer complex 137 reacting with iron oxides 164. In the underground formation, interaction between formation fluids and iron of downhole equipment causes corrosion releasing ferric and ferrous ions and forming iron-oxides. As the iron ions 164 form, they tend to react with L3-ligands 140, 142, and coat the surface of the porous silica particles 138. This causes rupturing of the cross-linking inside the complex 137 (e.g., the linking between the middle linker ($[Mg_3(COO)_4]^{2+}$) 139 and the L3-ligands 140, 142). The pores of the silica 134 can also open and release the tracer molecules 136. The tracer molecules 136 can travel to the surface through the formation fluids. Frequent sampling of the formation can be used for analysis to detect corrosion levels.

In some implementations, the embedded tracers 136 can utilize multi-coded tracer molecules or different types of tracer molecules. Such tracers can be utilized to demonstrate well connectivity in oil fields. In some implementations, multi-coded or multi-tracers can be embedded at different sections of the pipe so that detection of a certain tracer indicates the presence of the corrosion at a specific location along the pipe. In some implementations, the tracer layer is positioned between the inner and the outer diameter of the pipe (FIG. 2A). In this example, a modified manufacturing process can be used. For example, two composite sections of the pipe can be joined by a cladding or welding process. In some implementations, embedded multi-coded or multi-tracers can be used to uniquely mark different components of the downhole assembly or to mark different degrees of metal loss (i.e. corrosion levels).

Figure 5:
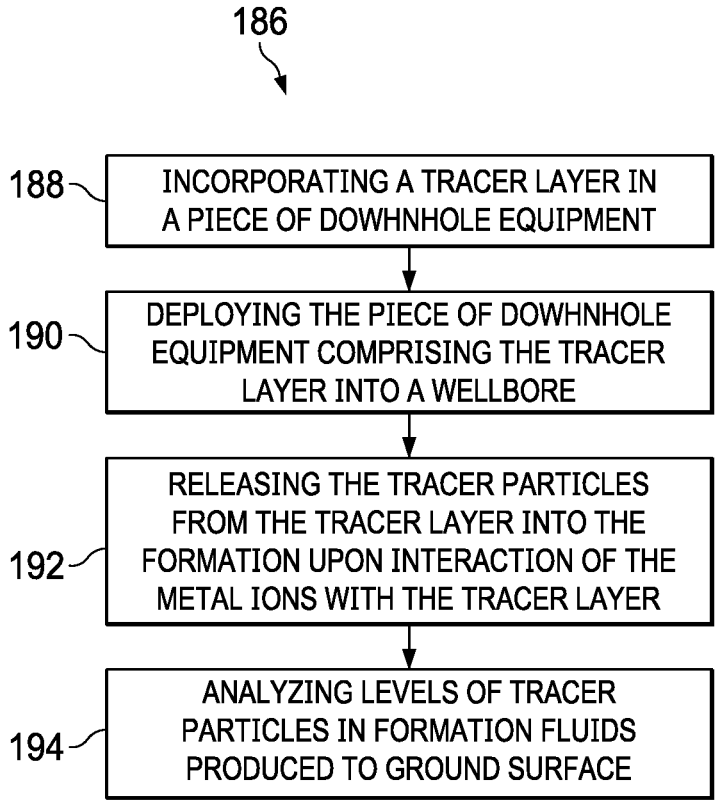
FIG. 5 is a flowchart of a method for detecting a corrosion in downhole equipment.

FIG. 5 is a flowchart of a method 186 for detecting a corrosion in downhole equipment. In operation, one or more tracer layers are incorporated in a piece of downhole equipment (188). The piece of downhole equipment is deployed in the subsurface reservoir including the tracer layer (190). Once the corrosion in the pipes occurs, the metallic tracer can act as a monitoring metric for metal loss in the pipe. When the level of the metal loss exposes the metallic tracers to interact with metal ions, the tracers are released into the formation (192). The formation samples include the tracer particles and are retrieved at the surface and taken to the lab for analysis to detect levels of corrosion (194). Frequent surface sampling can detect the tracer. Pre-established empirical relations, through calibration experiments in the lab, for the specific well conditions and selected materials, can be used to quantify the amount of iron ions that reacted with the polymer. The quantified amount of iron ions can be correlated with the released tracer concentrations and cumulative mass to locate the corrosion spot in the equipment.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Accordingly, the previously described example implementations do not define or constrain the present disclosure. Other changes, substitutions, and alterations are also possible without departing from the spirit and scope of the present disclosure.

A number of embodiments of these systems and methods have been described. Nevertheless, it will be understood that various modifications may be made without departing from the spirit and scope of this disclosure. Accordingly, other embodiments are within the scope of the following claims.

What is claimed is:

1. A method for detecting corrosion in downhole equipment, the method comprising: incorporating a tracer layer comprising tracer particles in a piece of downhole equipment;

deploying the piece of downhole equipment comprising the tracer layer into a wellbore;

releasing the tracer particles from the tracer layer into formation fluids in a formation of the wellbore upon interaction of metal ions with the tracer layer so production of the formation fluids carries particles to ground surface;

analyzing, at ground surface, levels of tracer particles in formation fluids produced to ground surface;

wherein incorporating the tracer layer in the piece of downhole equipment comprises applying the tracer layer as a coating on threads at casing or tubing joints.

2. The method of claim 1, wherein incorporating the tracer layer in the piece of downhole equipment comprises embedding the tracer layer into the piece of downhole equipment.

3. The method of claim 2, wherein incorporating the tracer layer in the piece of downhole equipment comprises incorporating a plurality of types of different tracer particles, each type of tracer particle associated with a different tracer layer.

4. The method of claim 2, wherein incorporating the tracer layer in the piece of downhole equipment comprises embedding the tracer layer in a pipe.

5. The method of claim 1, wherein deploying the piece of downhole equipment comprises deploying a plurality of tubulars comprising one or more tracer layers.

6. The method of claim 1, wherein incorporating the tracer layer comprising tracer particles in a piece of downhole equipment comprises encapsulating the tracer particles into a porous material.

7. The method of claim 6, wherein encapsulating the tracer particles into the porous material comprises encapsulating the tracer particles into a silica.

8. The method of claim 7, wherein encapsulating the tracer particles into the silica comprises adding the silica with the encapsulated tracer particles to a pipe composition.

9. The method of claim 8, wherein encapsulating the tracer particles into the silica comprises adding the silica with the encapsulated tracer particles to a cement composition.

10. The method of claim 8, wherein adding the silica with the encapsulated tracer particles to the pipe composition is between 1.5% and 35%.

11. The method of claim 1, wherein incorporating the tracer layer comprises incorporating the tracer layer with a thickness between 5% and 10% of an inner wall of a pipe.

12. A method for detecting corrosion in downhole equipment, the method comprising: incorporating a tracer layer comprising tracer particles in a piece of downhole equipment;

deploying the piece of downhole equipment comprising the tracer layer into a well bore;

releasing the tracer particles from the tracer layer into formation fluids in the formation upon interaction of metal ions with the tracer layer so production of the formation fluids carries particles to ground surface;

analyzing, at ground surface, levels of tracer particles in formation fluids produced to ground surface;

wherein releasing the tracer particles from the tracer layer into the formation upon interaction of metal ions with the tracer layer comprises releasing the tracer particles from the tracer layer into the formation upon interaction of metal ions at a concentration of between 0 and 5 μM with the tracer layer.

* * * * *